US005904203A

United States Patent [19]

Mai

[11] Patent Number: 5,904,203

[45] Date of Patent: May 18, 1999

[54] CHILL PLATE AND STACKED MOLD

[75] Inventor: Sumitoshi Mai, Kashiwazaki, Japan

[73] Assignees: Kabushiki Kaisha Riken, Tokyo; Riken Castec Corporation, Kashiwazaki, both of Japan

[21] Appl. No.: 08/746,565

[22] Filed: Nov. 13, 1996

[30] Foreign Application Priority Data

Nov. 17, 1995 [JP] Japan ..... 7-322512

[51] Int. Cl.[6] ..... B22D 15/04

[52] U.S. Cl. ..... 164/353; 164/355; 164/371; 249/111; 249/129; 264/327

[58] Field of Search ..... 249/111, 119, 249/129, 131, 126; 264/297.4, 327; 425/234; 164/323, 352, 353, 354, 355, 356, 371

[56] References Cited

U.S. PATENT DOCUMENTS

| | | | |
|---|---|---|---|
| 1,062,072 | 5/1913 | Wilson | 425/234 |
| 1,389,722 | 9/1921 | Webb | 249/126 |
| 4,785,871 | 11/1988 | Nakamura et al. | 164/355 |
| 5,072,773 | 12/1991 | Ruff et al. | 164/127 |
| 5,450,665 | 9/1995 | Madono et al. | 29/888.1 |
| 5,533,563 | 7/1996 | Lee, Sr. | 164/127 |

FOREIGN PATENT DOCUMENTS

| | | | |
|---|---|---|---|
| 0 456 290 A2 | 11/1991 | European Pat. Off. . | |
| 59-39446 | 3/1984 | Japan | 164/355 |
| 4-220151 | 8/1992 | Japan | 164/355 |

*Primary Examiner*—Patrick Ryan
*Assistant Examiner*—Joseph Leyson
*Attorney, Agent, or Firm*—Kubovcik & Kubovcik

[57] ABSTRACT

A compact stacked mold is provided by reducing the sand-metal ratio. Cavities (11, 12) are formed on upper and lower sides (13, 14) of a chill plate (10) corresponding to one half of a cam profile, and the upper and lower sides (13, 14) are aligned with parting surfaces of a mold (15).

5 Claims, 3 Drawing Sheets

CHILL PLATE AND STACKED MOLD

BACKGROUND OF THE INVENTION

The present invention relates to metal chill plates which are implanted in a mold or flask and a stacked flask assembly using the metal chill plates.

There is a wide range of application for composite materials having a chilled structure which is obtained by rapidly cooling a molten metal poured into a mold or flask having metal chill plates.

In industrial application, these composite materials are typically utilized for making automotive type engine cam shafts and similar types of engine parts in a manner that the cam shafts are cast within the mold in which the chill plates are located to produce hardened surface areas at pre-selected locations on the cam shafts.

Actually, in Japan and Europe, more than 70% of medium and small internal combustion engines excluding those for large ships use the cam shafts made of cast iron having chilled surface areas formed on cam or lobe portions. By chilling the entire circumferences of cam or lobe portions the hardness of the chilled portions and the micro-structures thereof can be further improved, thus, the application of such materials is increased.

Systems for casting the chilled cam shafts currently produced in Japan and Europe are generally classified into (1) casting using a green sand high pressure mold obtained by mechanical ramming and (2) casting using a mold hardened by using a chemical binder. In either case, a mold structure is employed in which the chill plates are implanted in the mold to forcibly cool and harden cam or lobe portions concurrently with casting. In the United States, the cam shafts are hardened by quenching because such automated implantation of the chill plates in the casting mold is not available.

The recent trend toward automobiles of higher performance has resulted in more complicated valve mechanisms, and this necessitates increasing the number of cams disposed within a predetermined length of the cam shaft and making the surfaces of the increased number of cams harder. For this reason, casting methods utilizing chill plates are attracting more attention.

Referring to casting process by implanting the chill plates in the mold, the green sand high pressure casting wherein water and green sand added with a binder are simply mechanically rammed has been found unsatisfactory in that it is limited in adaptability to product designs intended for the increased number of cams and in that water included in green sand reacts with poured molten metal in contact with the chill plates resulting in accidental internal gas defects which increase in proportion as the number of cams increases.

For the above reasons, the casting using the chemically hardened mold which easily accommodates to near net shapes and has high adaptability to product designs is more advantageous than the casting using the green sand high pressure mold, although the latter provides high productivity. Under such circumstances, most Japanese and European firms producing the chilled cam shafts employ casting based on a shell mold process or cold box process utilizing a chemically hardened mold, and only a limited number of firms employ casting using the green sand high pressure mold for items in limited design shapes.

The chemically hardened molds for the chilled cam shafts for the internal combustion engines of automobiles are produced using the shell mold process wherein upper and lower molds (cope and drag frames) are independently made and are aligned and bonded after manually implanting the chill plates therein. Gating systems used in this case include those to obtain horizontally poured and laterally arranged plural shots, vertically poured and laterally arranged multiple shots, vertically poured and longitudinally arranged plural shots, and vertically poured stack-cast laterally arranged multiple shots.

In the prior art as described above, the stack-cast laterally arranged system is preferred to any other system for casting of the cam shafts from the viewpoint of chill hardness, hardness of shafts, ease of forming hollow shafts, yield in terms of weight, productivity in molding, and productivity in pouring. However, this system has problems to be solved in the aspects of bending of shafts, casting defects, and automated implantation of chill plates and is to be improved further for a better sand-metal ratio. Especially, the sand-metal ratio makes it difficult to form a more compact stacked mold.

It is therefore an object of the present invention to solve the above problems and points to be improved.

SUMMARY OF THE INVENTION

The inventors have found the problems to be solved as described above attributable to the shape of a chill plate and attempted to improve the same. FIG. 4 shows a prior chill plate 1 developed by the applicant of the present invention. As illustrated, the mold has a configuration wherein a pair of split chill plates 3, 4 are prepared for a single cam profile 2; the lower chill plate 4 is implanted on a parting surface of a mold 5; and a space 6 is formed under the lower chill plate 4 to receive the upper chill plate 3 which is attached to the lower chill plate 4 to protrude above the parting surface. This makes upper and lower molds to be stacked considerably thick and, therefore, makes the resultant mold formed as a stacked cubic element large.

An improved chill plate according to the present invention is configured to have substantially the same height as a mold, a cavity corresponding in shape to one half of a member to be chilled on an upper surface thereof, and a cavity corresponding in shape to the other half of the member to be chilled on a lower surface thereof.

As apparent from comparison between FIG. 1 showing an embodiment of the invention and the prior embodiment, a combination of a pair of chill plates according to the embodiment of the invention substantially forms two cam profiles while only one cam profile is formed in the prior embodiment. The chill plates according to the present invention significantly help make a mold more compact also in this aspect.

A stacked mold according to the present invention has a configuration formed by stacking molds wherein laterally arranged chill plates are longitudinally staggered; parting surfaces of the mold are aligned with the parting surfaces of the two-part chill plates themselves; cavities corresponding in shape to one half of members to be chilled are provided on an upper surface of the chill plates; and cavities corresponding in shape to the other half of the members to be chilled are provided on a lower surface of the chill plates.

DETAILED DESCRIPTION OF PREFERRED EMBODIMENT

Figure 1:
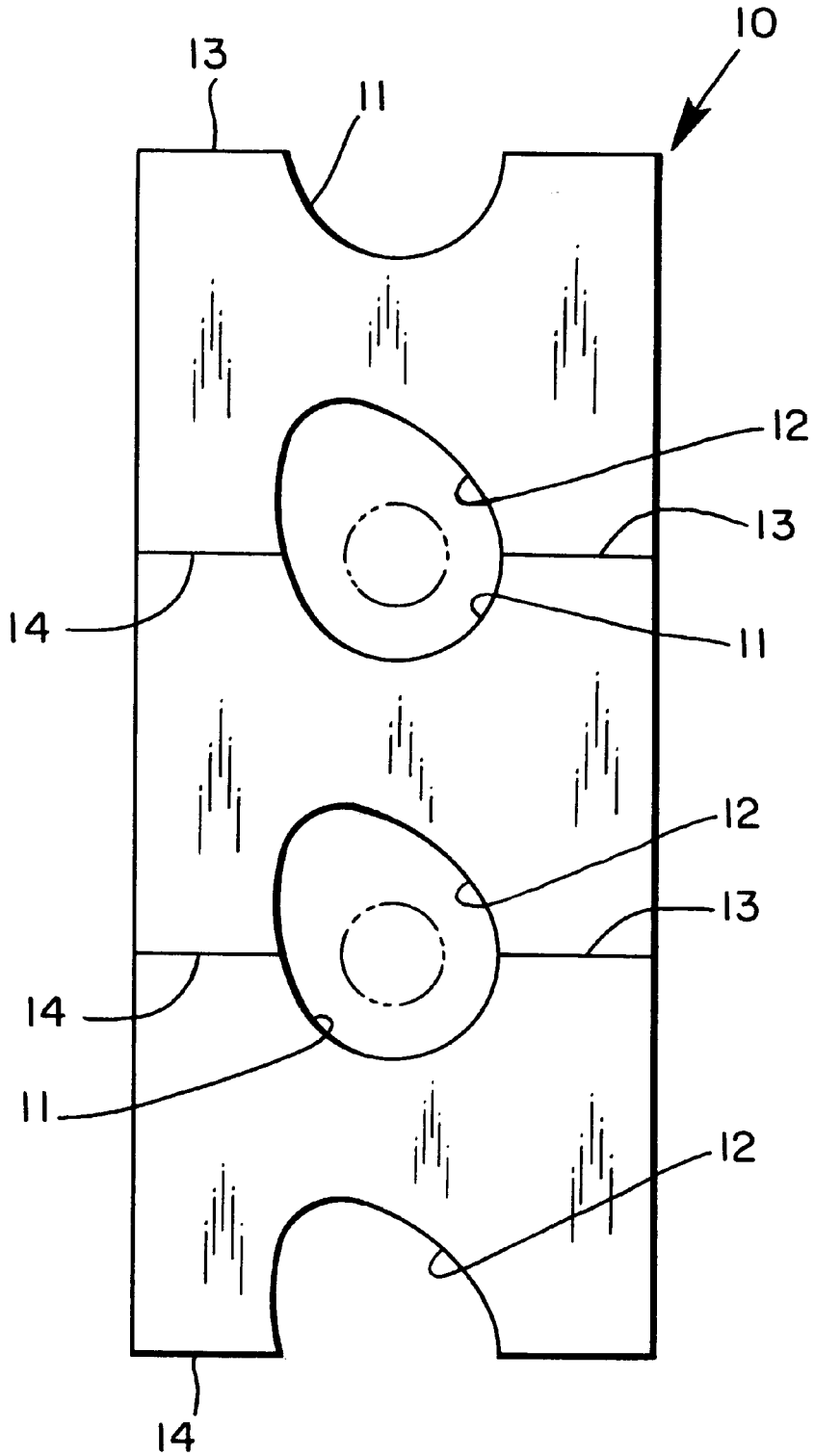
FIG. 1 is a front view of chill plates according to an embodiment of the present invention.

FIG. 1 shows chill plates 10 according to an embodiment of the present invention. The chill plates 10 have, on upper and lower parts thereof, an upper cavity 11 corresponding to the lower half of a cam profile of a cam shaft to be chilled and a lower cavity 12 corresponding to the upper half of the cam profile and have the same rectangular configuration having upper and lower sides 13 and 14 aligned with parting surfaces of molds.

A mold 15 formed of chemically hardened sand 16 in which the chill plates 10 in FIG. 1 are housed will be described with reference to FIGS. 2 and 3. The chemically hardened sand 16 is formed in the conventional manner. A plurality of cavities corresponding to shaft portions 17 of cam shafts are laterally arranged to be in parallel in the longitudinal direction thereof, and each cavity for the shape of one half of the shaft portions 17 is formed of sand 16 in the mold 15 so that it is located on upper and lower surfaces thereof. The chill plates are disposed in predetermined positions where they are orthogonal to the shaft portions 17. The upper and lower sides 13, 14 of the chill plates 10 are aligned with parting surfaces of the mold 15, allowing the cavities 11, 12 to be vertically opened.

Chill plates 10 disposed in association with adjacent shaft portions 17 are offset from each other to be staggered. This allows the adjacent shaft portions 17 to be made close to each other and therefore allows the mold 15 to be compact when considered in relation to the number of the cam shafts cast therein.

Figure 2:
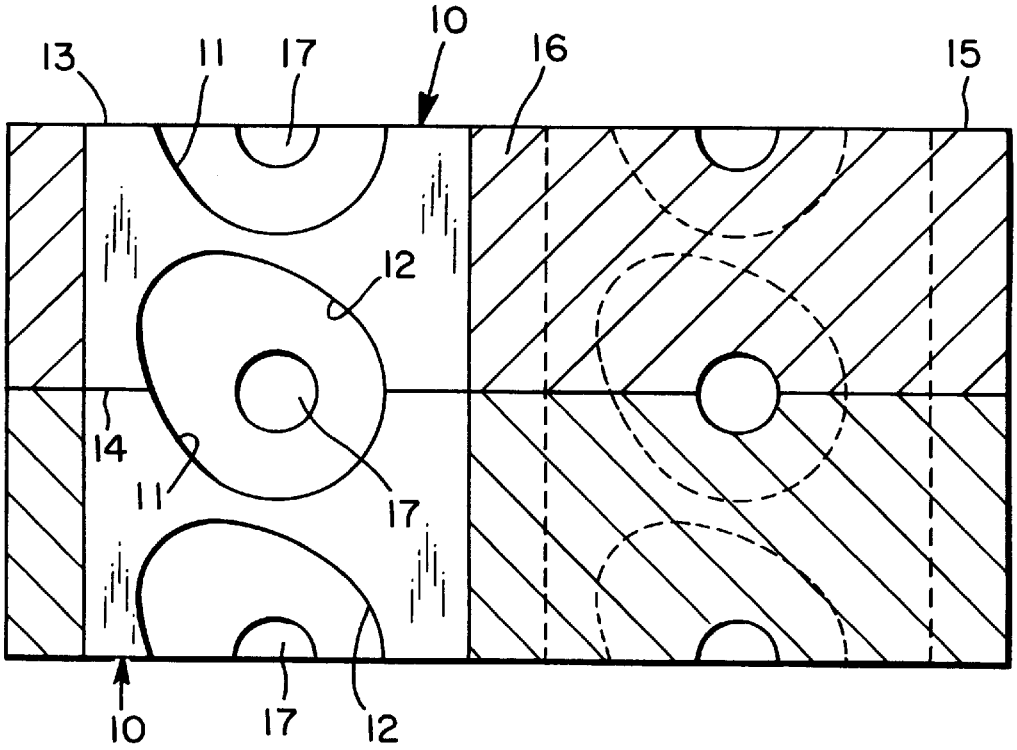
FIG. 2 is a sectional view showing an example of stacked molds.
Figure 3:
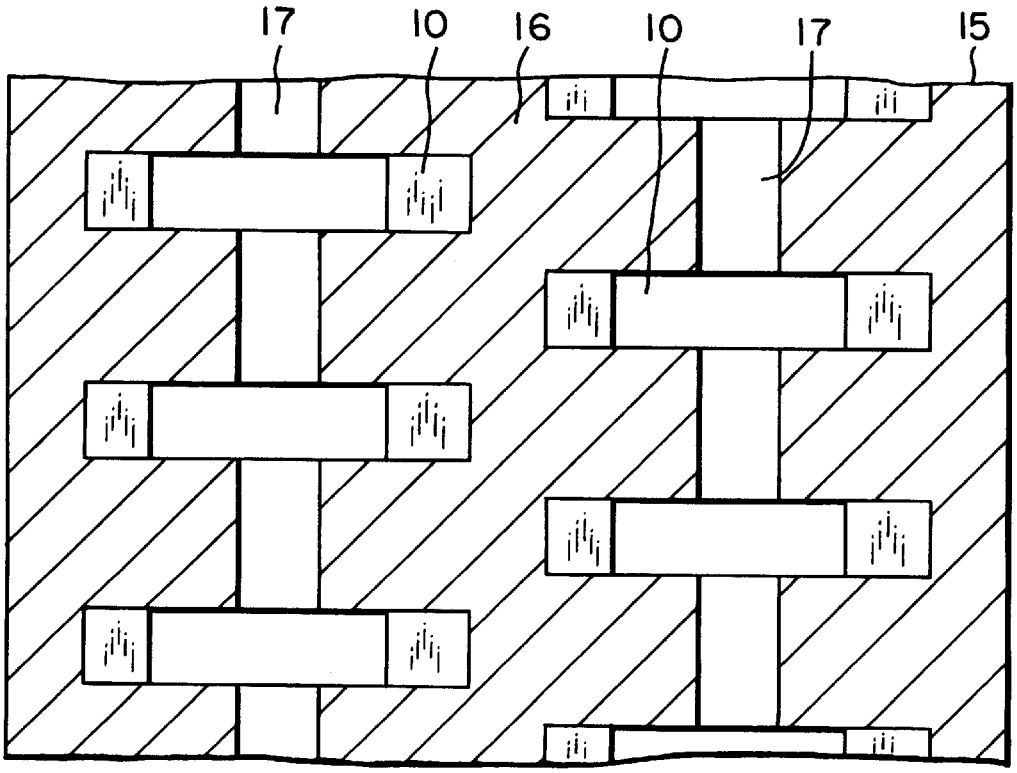
FIG. 3 is a plan view of a mold.
Figure 4:
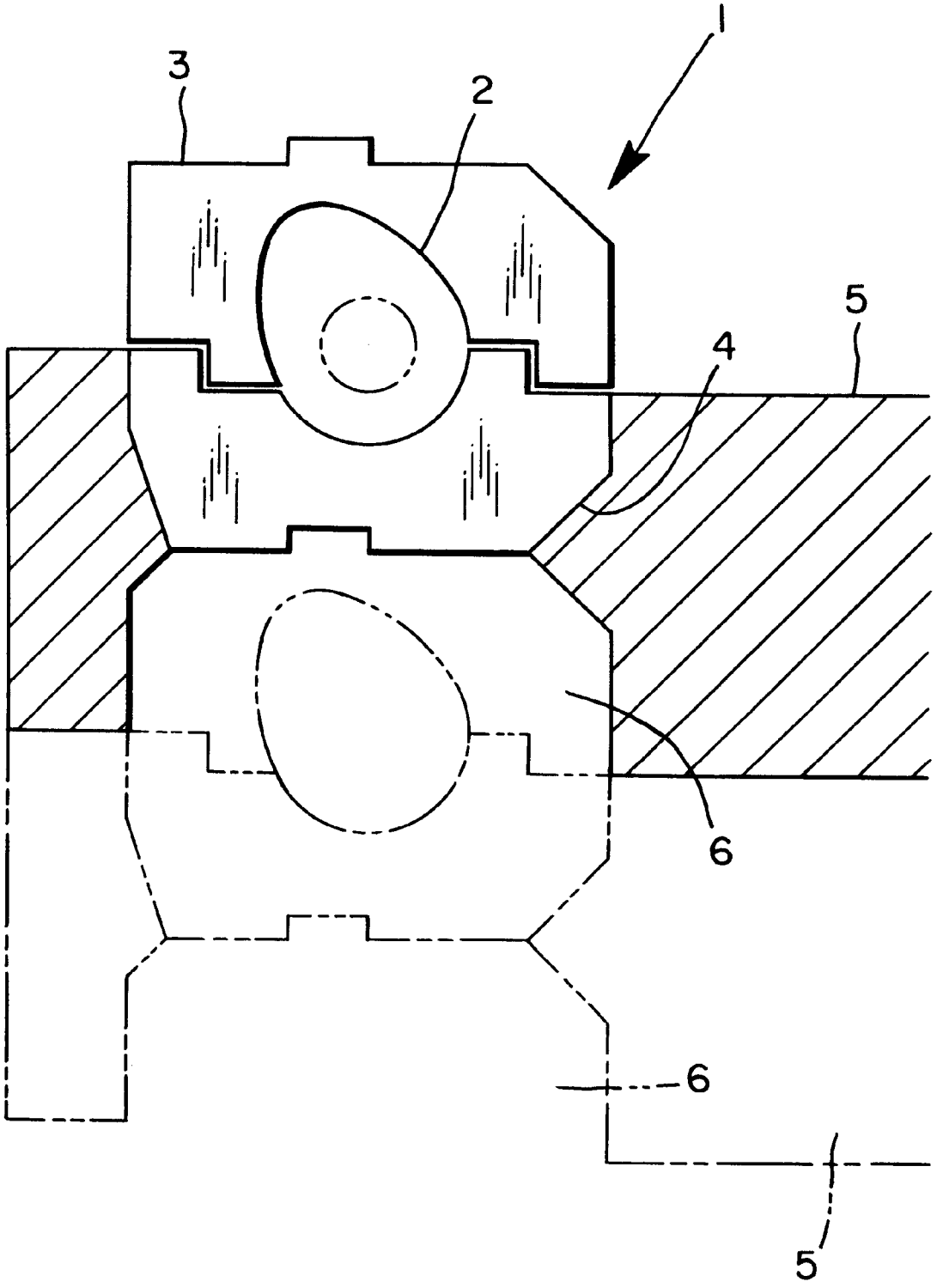
FIG. 4 is a sectional view of a mold utilizing prior chill plates.

As shown in FIG. 2, the molds 15 are stacked so that the cavities corresponding to the cam or lobe profiles and shaft portions are defined by simply matching the parting surfaces of the molds 15.

In the structure according to the present invention, for a cam profile (which corresponds to a member to be chilled), both of split upper and lower cam profiles are provided in a single chill plate. This makes it possible to reduce the number of implanted chill plates to one half of that in the prior art and to reduce the overall height and width of the molds.

Since the parting surfaces of molds and two-part chill plates are aligned with each other, nothing protrudes from the parting surfaces of the molds. This allows mechanized automatic closing of the upper mold.

The chill plate is basically shaped to have a simple rectangular outline, and a structure is provided for positioning each cam such that small steps on both sides thereof as a function of the height and width thereof allow any structural error to be distinguished. The chill plates can be stably fed during screening and aligning because of their rectangular outline, and a structure can be provided with which automatic screening can be quickly and reliably performed through image processing using indicators provided in blank areas on the surfaces.

The chill plates are outlined to have a simple rectangular structure with a constant height. This allows a storage magazine to have a very simple structure. Further, since the chill plates have identical rectangular upper and lower surfaces, they can be stacked and stored as they are, which simplifies a mechanism for implanting the chill plates on the surfaces of molds on an automatic insertion machine at a time.

Molds are stacked with chill plates each having the same height as the molds into a cubic element. As a result, even if the strength of the molds is deteriorated or the wall of the molds is collapsed by heat after molten metal is solidified, a rigid structure may be provided on the lowermost pallet to bind the cams around the entire circumference thereof, with the chill plates in the same number as the cams serving as a support post. This prevents the products themselves from being naturally deformed and dramatically reduces the amount of bending deformation.

While a specific illustrated embodiment has been shown and described, it will be obvious to those skilled in the art that various changes and modifications may be made to the invention without departing from the spirit and scope of the invention as set forth in the appended claims.

What is claimed is:

1. A chill plate for a stacked mold having substantially the same height as a mold of the stacked mold and comprising a cavity corresponding in shape to one half of a member to be chilled on an upper surface thereof and a cavity corresponding in shape to the other half of said member to be chilled on a lower surface thereof.

2. A chill plate according to claim 1, wherein parting surfaces of said chill plate are aligned with parting surfaces of said mold of the stacked mold.

3. A stacked mold comprising molds stacked on one another, wherein laterally arranged chill plates are longitudinally staggered within the molds; parting surfaces of said molds are aligned with the parting surfaces of said chill plates themselves; cavities corresponding in shape to one half of members to be chilled are provided on an upper surface of said chill plates; and cavities corresponding in shape to the other half of said members to be chilled are provided on a lower surface of said chill plates.

4. A stacked mold according to claim 3, wherein said chill plates are formed to have the same rectangular outline.

5. A stacked mold according to claim 3, wherein said molds are chemically hardened molds.

* * * * *